US005802847A

United States Patent [19]

Harnischfeger

[11] Patent Number: 5,802,847

[45] Date of Patent: Sep. 8, 1998

[54] HYDRAULIC SYSTEM FOR A MOBILE WORK DEVICE, IN PARTICULAR A WHEEL LOADER

[75] Inventor: Edwin Harnischfeger, Bad Orb, Germany

[73] Assignee: Mannesmann Rexroth AG, Lohr/Main, Germany

[21] Appl. No.: 737,363

[22] PCT Filed: May 25, 1995

[86] PCT No.: PCT/EP95/01556

§ 371 Date: Nov. 1, 1996

§ 102(e) Date: Nov. 1, 1996

[87] PCT Pub. No.: WO95/30800

PCT Pub. Date: Nov. 16, 1995

[30] Foreign Application Priority Data

May 7, 1994 [DE] Germany ..... 44 16 228.6

[51] Int. Cl.[6] ..... F16D 31/02

[52] U.S. Cl. ..... 60/413; 60/494

[58] Field of Search ..... 60/413, 494

[56] References Cited

U.S. PATENT DOCUMENTS

| | | | |
|---|---|---|---|
| 4,096,878 | 6/1978 | Adams . | |
| 4,240,515 | 12/1980 | Kirkwood | 60/413 X |
| 4,995,517 | 2/1991 | Saotome | 60/413 X |
| 5,116,188 | 5/1992 | Kurohashi et al. | 60/413 X |
| 5,520,499 | 5/1996 | Ufheil et al. | 60/413 X |

FOREIGN PATENT DOCUMENTS

| | | |
|---|---|---|
| 2502666 | 8/1976 | Germany . |
| 3909205 | 5/1990 | Germany . |
| 4021347 | 1/1992 | Germany . |
| 4129509 | 3/1993 | Germany . |
| 4231399 | 2/1994 | Germany . |

*Primary Examiner*—Hoang Nguyen
*Attorney, Agent, or Firm*—Martin A. Farber

[57] ABSTRACT

A hydraulic system for a mobile machine, in particular a wheel loader, has a longitudinal oscillation damping function. The hydraulic system has at least one hydraulic cylinder (13) with which a tool can be operated and whose inner space is divided by a piston (15) into two pressure chambers (17, 18); a stop valve (12) which connects one of the two pressure chambers (17, 18) to a hydraulic reservoir (42) which can be filled via a filling pipe; and a distributing or directional control valve (11) with a spool or slide valve (40) for the separate pressurization of the two pressure chambers (17, 18) in the hydraulic cylinder (13) and/or for connecting them to a tank (29). To facilitate low-cost and space-saving construction of a system of this type, the stop valve is incorporated in the distributing valve (11) in such a way that the hydraulic reservoir (42) and the first pressure chamber (17) of the hydraulic cylinder (13) can be connected to each other via the spool valve (40) of the distributing valve (11).

10 Claims, 1 Drawing Sheet

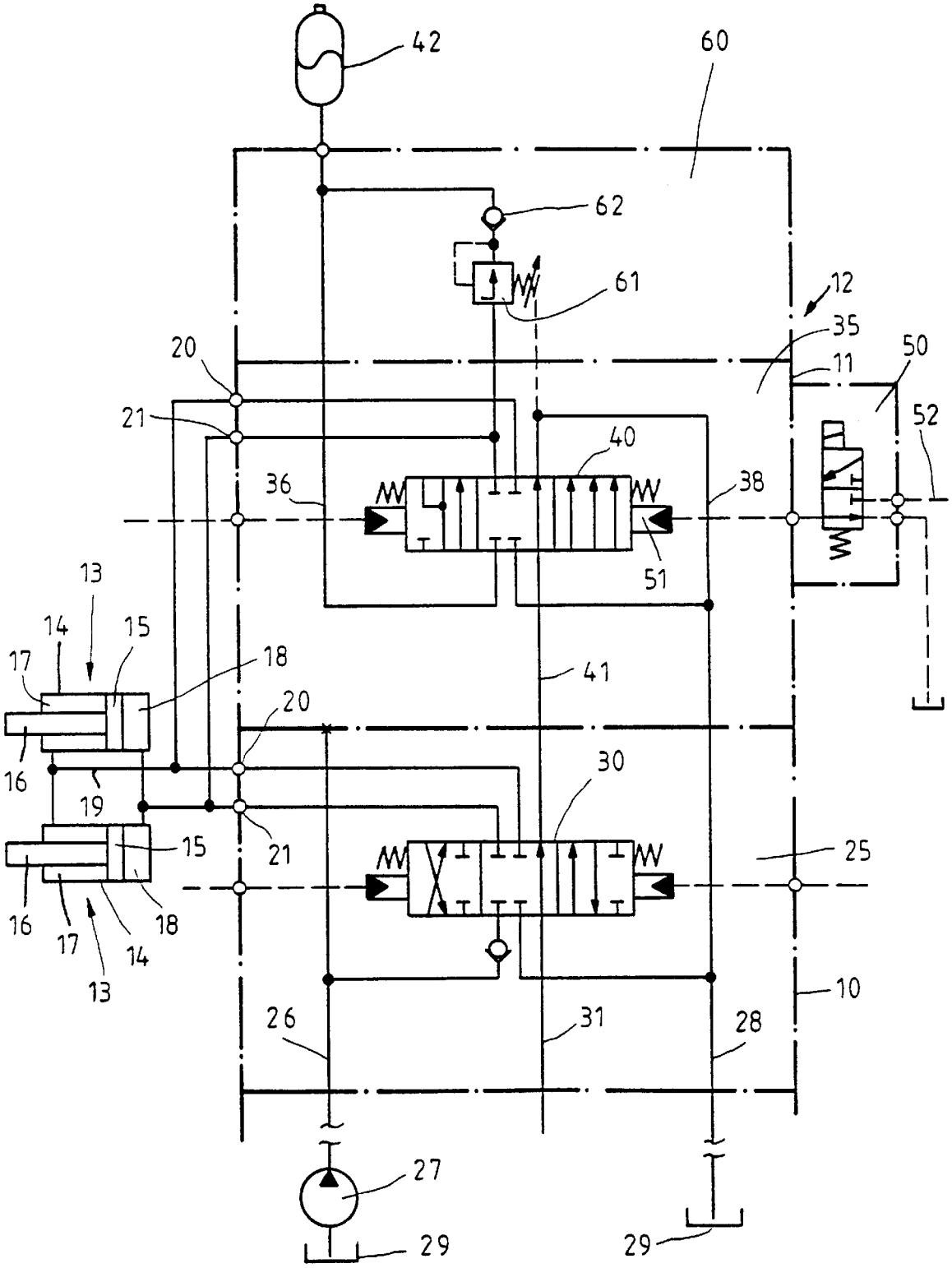
42
60
62
61
12
35
50
11
52
20
21
40
36
38
51
13
14
15
17
18
41
20
16
19
30
15
21
25
16
17
18
14
13
10
26
31
28
27
29
29

HYDRAULIC SYSTEM FOR A MOBILE WORK DEVICE, IN PARTICULAR A WHEEL LOADER

FIELD AND BACKGROUND OF THE INVENTION

The present invention is based on a hydraulic system which is used for a mobile work device, particularly a wheel loader.

From Federal Republic of Germany 39 09 205 C1, it is known to dampen the pitching oscillations of wheel loaders which take place, particularly with the loading shovel full and a high speed of travel, by means of a damping system which is part of the hydraulic system of the wheel loader. For the damping of the oscillation, the, in general, two hydraulic lift cylinders for the raising and lowering of the loading shovel can be connected by a shut-off valve to a hydraulic accumulator which can be loaded by a hydraulic pump via a filling line. The shut-off valve which is arranged between the hydraulic accumulator and the lift cylinders is closed as long as the loading shovel is being used and it can be opened manually by the driver or automatically as soon as pitching oscillations occur upon travel or as soon as the speed of travel exceeds a given value of, for instance, 6 km/hour. A hydraulic control system of a wheel loader comprises, as is also known from Federal Republic of Germany 39 09 205 C1, several directional control valve devices one of which serves to supply the lift cylinders with pressurized fluid for the raising and lowering of the loading shovel. In accordance with Federal Republic of Germany DE 39 09 205 C1, this directional control valve also has a switch position in which the two pressure chambers of each lift cylinder are connected to the tank. In this switch position of the directional control valve, the loading shovel rests with its weight on the ground and can be pulled or pushed over the ground in order to level it. It floats, so to speak, on the ground, for which reason the corresponding switch position of the directional control valve is also known as the "floating" switch position. The "floating" function can—as can be noted from Federal Republic of Germany 41 29 509 A1—also be obtained by an additional directional control valve which, in one switch position, connects the two pressure chambers of each lift cylinder to each other and to the tank.

SUMMARY OF THE INVENTION

The object of the present invention is further to develop such a hydraulic control device in such a manner that a compact, space-saving construction is possible, that the expense for piping is reduced; and that the cost of manufacture can be favorable.

This object is achieved in accordance with the invention by a hydraulic system whenever, the shut-off valve is so integrated in the directional control valve by which the two pressure chambers of the hydraulic cylinder can be separately pressurized and/or jointly connected to the tank that the hydraulic accumulator and the first pressure chamber of the hydraulic pump can be connected to each other via the control slide of the directional control valve. In a hydraulic system in accordance with he invention therefore, in addition to the directional control valves there is not only also present an additional shut-off valve. Rather, one of the directional control valves also serves the function of the shut-off valve. In this way, the expense for the piping is less, the manner of construction is compact and space-saving, and the cost is reduced.

Advantageous developments of a hydraulic system in accordance with the invention.

During a connection of the first pressure chamber with the hydraulic accumulator the second pressure chamber is at the same time connected to the tank. Thus, no pressure can be produced in the second pressure chamber and the piston of the hydraulic cylinder can oscillate without cavitation.

In agreement with the hydraulic system of Federal Republic of Germany 41 29 509 A1, a first directional control valve via which the two pressure chambers of the hydraulic cylinder can be connected alternately to a hydraulic pump and to the tank, and a second directional control valve via which the two pressure chambers can be connected jointly to the tank and by which, therefore, the "floating" function is realized, are present.

Not only the connecting of the first pressure chamber of the hydraulic cylinder to the hydraulic accumulator but also the connecting of the second pressure chamber to the tank can be brought about by an actuation of the second directional control valve. If one disregards a possible precontrol valve for the second directional control valve, then, aside from this directional control valve, no further directional control valve need be actuated for the "damping" function of the hydraulic system.

A valve housing of substantially the same development is used for the second directional control valve and a further directional control valve which form adjacent sections of a valve block.

BRIEF DESCRIPTION OF THE DRAWING

With the above and other objects and advantages in view, the present invention will become more clearly understood in connection with the detailed description of a preferred embodiment, when considered with the accompanying drawing in which the sole figure is a schematic illustration of a hydraulic system in accordance with the invention.

DETAILED DESCRIPTION OF THE PREFERRED EMBODIMENT

In the drawing there can be noted a first directional control valve 10 and a second directional control valve 11 which form directly adjacent sections of a valve block 12 to which further directional valve control sections not shown in detail belong. The directional control valve 10 serves to actuate two lift cylinders which are connected in parallel to each other and via them to raise and lower the loading shovel of a wheel loader. Each lift cylinder 13 contains within a cylinder housing 14 a piston 15 having a piston rod 16, the piston dividing the inside of the housing 14 into a piston-rod-side annular pressure chamber 17 and a piston-rod remote-side pressure chamber 18. The piston-rod-side pressure chambers 17 of the lift cylinders 13 are connected via a consumption line 19 to a first connection 20 of the directional control valve 10. The pressure chambers 10 are connected via a line 21 with a connection 21 of the directional control valve 10.

This directional control valve 10 has a valve housing 25 through which, in the direction of the series connection with the directional control valve 11, a pressure channel 26 which is connected with the pressure connection of a hydraulic pump 27 and a tank channel 28 which debouches into a tank 29 pass. The opening cross sections of these two channels are not influenced by the position of the control slide 30 of the directional control valve 10. A further channel 31 which extends through the valve housing 25 is referred to as a by-pass channel, which is open in a central position of the control slide 30 and upon a displacement of the control slide 30 from the spring-centered central position in one direction or the other is closed more and more until completely closed off. The by-pass channel 31 passes also through the further directional control valve sections of the valve block 12 arranged on the side of the section 10 facing away from the directional valve section 11, can be acted on by the control slides of the further directional control valve sections in the same way as by the control slide 30 and is finally connected with the pressure channel 26. Upon a displacement of the control slide 30 from the central position, the connection 21 is connected to the pressure channel 26 and the connection 20 is connected to the main channel 28. In this way, the pressure chambers 18 are pressurized and the pressure chambers 17 are relieved to the tank. The piston rods 16 travel outward and the loading shovel of the wheel loader is raised. Upon displacement of the control slide 30 in the opposite direction, the pressure chambers 17 are pressurized and the pressure chambers 18 are relieved to the tank. The loading shovel descends.

The housing 35 of the directional control valve 11 is substantially the same as the housing 25 of the directional control valve 10. It has a channel 36 in the extension of the pressure channel 26 of the valve 10, a tank channel 38 as an extension of the tank channel 28, and a corresponding by-pass channel 41 which continues the by-pass channel 31 of the directional control valve 10. The by-pass channel 40, as can be noted from the switch symbol, is connected to the tank channel 18 in every position of the control slide 40 of the directional control valve 11 so that it is also possibly to produce a permanent connection between the by-pass channel 31 and the tank channel 28 within the housing 25 of the directional control valve 10 and to dispense with a by-pass channel in the housing 35 of the directional control valve 11. The tank channels 28 and 38 are namely open towards each other. On the other hand, the channel 36 of the valve housing 35 is closed off from the pressure channel 26 of the valve housing 25. This closure can be provided also in the casting for the valve housing 35, but it can also be effected subsequently. On the side of the valve housing 35 facing away from the directional control valve 10, the channel 36 is open. It is connected to a hydraulic accumulator 42.

In the same way as the directional control valve 10, the directional control valve 11 also has two consumer connections 20 and 21, the consumer connection 20 being connected in the same way as the corresponding connection of the directional control valve 10 to the pressure chambers 17, and the consumption connection 11 being connected in the same way as the corresponding connection of the directional control valve 10 to the pressure chambers 18 of the lift cylinders 13. In the spring-centered central position of the control slide 10, the two consumer connections 20 and 21 as well as the channels 36 and 38 are closed off from each other. In the one lateral position, the consumer connections 20 and 21 are connected to the channel 38 and thus to the tank 29, while the channel 36 is closed off. Thus, tank pressure prevails in both pressure chambers 17 and 18 of the lift cylinders 13. The loading shovel of a wheel loader can be pulled away over the ground in order to level it. By the corresponding actuation of the control slide 40, the "floating" function is thus realized. Upon a displacement of the control slide 40 from the central position into the opposite direction, the connection 20 of the directional control valve 11 is connected with the channel 38, and therefore with the tank 29, and the connection 21 is connected with the channel 36, and therefore with the hydraulic accumulator 42. The pressure chambers 17 of the lift cylinders 13 are thereby relieved to the tank, while the pressure chambers 18 are connected to the hydraulic accumulator 42. Oil can therefore be pumped back and forth between the pressure chambers 18 and the hydraulic accumulator 42 so that the jib of the wheel loader with the loading shovel and the loader itself no longer form a rigid system and pitching oscillations are dampened.

By the further lateral displacement of the control slide 40, the "damping" function is therefore realized.

A displacement of the control slide 40 into this position is effected intentionally by the operator or automatically when the wheel loader has reached a given speed of travel. An electromagnetically actuatable pre-control valve 50 is then actuated and a control pressure chamber 51 of the directional control valve 10, which is relieved to the tank in the position of rest of the valve 50, is connected with a line 52 which is acted on by the maximum control pressure which is available for the actuating of the directional control valves of the block 12.

The accumulator 42 can be charged via a filling-valve arrangement 60 up to an adjustable maximum pressure and for this purpose connected via the filling valve arrangement with the pressure chambers 18 of the lift cylinders 13. In the present example, this takes place in the manner that the valve arrangement 60 is connected within the valve housing 35 of the directional control valve 11 with a channel leading to the connection 21 of this valve. The connection could, however, also be made outside the valve housing 35 or within the housing 25. The valve arrangement 60 comprises a pressure-reduction valve 61 and a return valve 62 which opens towards the hydraulic accumulator and is connected between the pressure-reduction valve and the hydraulic accumulator 42.

When the pressure chambers 18 of the lift cylinders 13 are pressurized by actuation of the directional control valve 10, the hydraulic accumulator 42 is filled via the valves 61 and 62 up to the pressure prevailing in the compression chambers 18 insofar as this pressure does not exceed the value set on the pressure-reduction valve. Ordinarily the pressure in the pressure chambers 18 remains below the value set, so that the maximum pressure which has occurred in the hydraulic accumulator 42 and which is held in the hydraulic accumulator by the return valve 62 prevails in the hydraulic accumulator.

I claim:

1. A hydraulic system for a mobile working device, having a working tool which can be actuated via at least one hydraulic cylinder (13) having a piston (15) which divides the inside of the hydraulic cylinder (13) into two pressure chambers (17, 18), having a hydraulic accumulator (42) which can be loaded via a filling line, and having a directional control valve (11) with a control slide (40) for the separate pressurization of the two pressure chambers (17, 18) of the hydraulic cylinder (13) or for the connecting of the two pressure chambers (17, 18) of the hydraulic cylinder (13) to a tank (29), wherein the hydraulic accumulator (42) and the first pressure chamber (18) of the hydraulic cylinder (13) are connectable with each other via the control slide (40) of the directional control valve (11).

2. A hydraulic system according to claim 1, wherein during a connection of the first pressure chamber (18) to the hydraulic accumulator (42), the second pressure chamber (17) is connected to the tank (29).

3. A hydraulic system according to claim 1, wherein said directional control valve is a second directional control valve, and the hydraulic system further comprises a first directional control valve (10), wherein the two pressure chambers (17, 18) of the hydraulic cylinder (13) can be connected via the first directional control valve (10) alternately to a hydraulic pump (27) and the tank (29), the two pressure chambers (17, 18) can be connected jointly with the tank via the second directional control valve (11), and that the hydraulic accumulator (42) and the first pressure chamber (18) of the hydraulic cylinder (13) can be connected with each other via the control slide (40) of the second directional control valve (11).

4. A hydraulic system according to claim 2, wherein both the connection of the first pressure chamber (18) of the hydraulic (13) to the hydraulic accumulator (42) and the connection of the second compression chamber (17) to the tank (29) can be produced by an actuation of the second directional control valve (11).

5. A hydraulic system according to claim 3, wherein the second directional control valve (11) and the first directional control valve (10) are adjacent sections of a valve block (12), that the second directional control valve (11) and the first directional control valve (10) have valve housings (25, 35) which are substantially of identical development and have a channel (26, 36) extending in the direction of the arrangement one behind the other, aligned with the channel (36, 26) of the other valve housing (35, 32), from which channel (26, 36) a connection exists to the valve bore receiving the corresponding control slide (30, 40); that the two channels (26, 36) are closed off from each other; and that the channel (36) of the second directional control valve (11) is connected to the hydraulic accumulator (42) and the channel (26) of the first directional control valve (10) is connected to the pressure connection of the hydraulic pump (27).

6. A hydraulic system according to claim 2, wherein said directional control valve is a second directional control valve, and the hydraulic system further comprises a first directional control valve (10), wherein the two pressure spaces (17, 18) of the hydraulic cylinder (13) can be connected via the first directional control valve (10) alternately to a hydraulic pump (27) and the tank (29), that the two pressure chambers (17, 18) can be connected jointly with the tank via a second directional control valve (11), and that the hydraulic accumulator (42) and the first pressure chamber (18) of the hydraulic cylinder (13) can be connected with each other via the control slide (40) of the second directional control valve (11).

7. A hydraulic system according to claim 6, wherein both the connection of the first pressure chamber (18) of the hydraulic cylinder (13) to the hydraulic accumulator (42) and the connection of the second compression chamber (17) to the tank (29) can be produced by an actuation of the second directional control valve (11).

8. A hydraulic system according to claim 4, wherein the second directional control valve (11) and the first directional control valve (10) are adjacent sections of a valve block (12), that the second directional control valve (11) and the further directional control valve (10) have valve housings (25, 35) which are substantially of identical development and have a channel (26, 36) extending in the direction of the arrangement one behind the other, aligned with the channel (36, 26) of the other valve housing (35, 32), from which channel (26, 36) a connection exists to the valve bore receiving the corresponding slide (30, 40); that the two channels (26, 36) are closed off from each other; and that the channel (36) of the second directional control valve (11) is connected to the hydraulic accumulator (42) and the channel (26) if the first directional control valve (10) is connected to the pressure connection of the hydraulic pump (27).

9. A hydraulic system according to claim 6, wherein the second directional control valve (11) and the first directional control valve (10) are adjacent sections of a valve block (12), that the second directional valve (11) and the first directional control valve (10) have valve housings (25, 35) which are substantially of identical development and have a channel (26, 36) extending in the direction of the arrangement one behind the other, aligned with the channel (36, 26) of the other valve housing (35, 32), from which channel (26, 36) a connection exists to the valve bore receiving the corresponding control slide (30, 40); that the two channels (26, 36) are closed off from each other; and that the channel (36) of the second directional control valve (11) is connected to the hydraulic accumulator (42) and the channel (26) of the first directional control valve (10) is connected to the pressure connection of the hydraulic pump (27).

10. A hydraulic system according to claim 7, wherein the second directional control valve (11) and the first directional control valve (10) are adjacent sections of a valve block (12), that the second directional control valve (11) and the first directional control valve (10) have valve housings (25, 35) which are substantially of identical development and have a channel (26, 36) extending in the direction of the arrangement one behind the other, aligned with the channel (36, 26) of the other valve housing (35, 32), from which channel (26, 36) a connection exists to the valve bore receiving the corresponding control slide (30, 40); that the two channels (26, 36) are closed off from each other; and that the channel (36) of the second directional control valve (11) is connected to the hydraulic accumulator (42) and the channel (26) of the first directional control valve (10) is connected to the pressure connection of the hydraulic pump (27).

* * * * *